United States Patent [19]

Briggs

[11] 4,004,696

[45] Jan. 25, 1977

[54] MATERIAL HANDLING APPARATUS WITH LOAD COMPENSATED COUNTERWEIGHT SYSTEM

[75] Inventor: Aubrey C. Briggs, Carnegie, Pa.

[73] Assignee: Dravo Corporation, Pittsburgh, Pa.

[22] Filed: Oct. 17, 1975

[21] Appl. No.: 623,362

[52] U.S. Cl. ..... 212/49; 214/142

[51] Int. Cl.[2] ..... B66C 23/72

[58] Field of Search ..... 37/190 R, 190 B, 189; 212/48, 49; 214/142; 198/36

[56] References Cited

UNITED STATES PATENTS

| | | | |
|---|---|---|---|
| 3,530,999 | 9/1970 | Naruns | 212/49 |
| 3,750,895 | 8/1973 | Durand | 212/49 X |
| 3,767,030 | 10/1973 | Briggs | 212/49 X |
| 3,851,767 | 12/1974 | Durand | 212/48 |

*Primary Examiner*—Gary L. Smith

*Attorney, Agent, or Firm*—Parmelee, Miller, Welsh & Kratz

[57] ABSTRACT

A beam cantilevered from the pivoted end of the elongated boom on a material handling structure is coupled at its outer end to a pivoted strut carrying a counterweight connected through tension bars to a point well out on the boom such that a portion of the moment generated by the counterweight is removed from the boom and supported by the cantilevered beam in the absence of live load on the boom. As live load is applied and the boom begins to bend, the tension bars pivot the counterweight strut relative to the cantilevered beam thereby relieving the loading on the cantilevered beam and applying the full moment developed by the counterweight to the boom.

9 Claims, 8 Drawing Figures

MATERIAL HANDLING APPARATUS WITH LOAD COMPENSATED COUNTERWEIGHT SYSTEM

BACKGROUND OF THE INVENTION

1. Field of the Invention

This invention relates to material handling structures having a vertically pivotal boom of extended horizontal length and more particularly to apparatus for counterbalancing and stiffening such structures.

2. Prior Art

Material handling structures having vertically pivotal booms of extended horizontal length are conventionally counterbalanced by weights disposed diametrically opposite the boom. In some of these structures, the counterweight is mounted on a pivoted strut. A cable or other tension member is connected between the counterweight and a point well out on the boom. The intermediate portion of the tension member is held aloft by a king post truss or other structure such that a vertical component of the tension member force counterbalances the boom. In such structures, a horizontal component of the tension member force applies a longitudinal force to the extended length boom. As the boom is raised and lowered, the counterweight moves in the opposite direction to maintain the counterbalancing force. One advantage of such an arrangement is that the structure remains properly counterbalanced even if the boom should come to rest on an object or the luffing cables or mechanism should fail.

Structures of the above type are often used in stacking and reclaiming bulk materials, such as coal and ores, and may have booms 100 to 200 feet in length. A digging device, such as a bucket wheel mounted on the end of the boom, deposits bulk material on a conveyor which extends the length of the boom. For stacking bulk material, the direction of the conveyor is reversed. The forces developed by the bucket wheel at the end of the boom and the weight of the bulk material along the length of the conveyor impose a sizable live load on the 100 to 200 foot boom which causes it to bend. The bending of the boom produces an uneven bench in the stack being reclaimed as the boom becomes fully loaded. This is considered very undesirable by users of the machine. Under some circumstances, the bending can cause the bucket wheel to dig in and stall.

The counterweight acting through the cable or tension bar connected well out on the boom tends to counteract to some extent the droop produced by the live load. Although it may seem suitable at first to increase the size of the counterweight to reduce the droop further, this is not a satisfactory solution since the larger counterweight causes the boom to bend upward upon removal of the live load and, therefore, the total deflection remains the same. In addition, if the size of the counterweight is increased to counteract the live load, the buckle strength of the boom can well be exceeded when the liveload is removed.

SUMMARY OF THE INVENTION

As applied to material handling apparatus of the type having a boom pivoted at one end for movement in a vertical plane, a counterweight mounted on a strut extending in the direction opposite the boom, and a tension member connected at one end to the counterweight, at the other end to a point well out on the boom and held aloft at an intermediate point by a frame such that the moment generated by the counterweight is transmitted through the tension member to counterbalance the boom, the invention comprises a beam cantilevered outward from the pivoted end of the boom in the direction of the strut and means coupling the strut to the outer portion of the cantilevered beam to transfer a portion of the moment produced by the counterweight to the cantilevered beam member as live load on the boom is decreased. Preferably, the frame which holds the intermediate portion of the tension member aloft is a king post truss pinned at the lower end to the boom and at the upper end to the tension member.

A predetermined portion of the counterweight moment may be transferred to the cantilevered beam in the absence of substantially all live load. In the preferred embodiment of the invention, this is achieved by disposing the cantilevered beam member above the strut and coupling the strut to the cantilevered beam through a linkage which draws the outer portions of the cantilevered beam member and strut toward each other to apply, through bending, the predetermined load on the cantilevered beam member. With this arrangement, the cantilevered beam may be cambered upward toward the outer end such that upon the application of the predetermined load thereto, the cantilevered beam becomes substantially straight.

In the embodiment disclosed, the strut includes a pair of longitudinal members disposed on either side of the boom, and the cantilevered beam member includes a pair of cantilevered beams, one of which is disposed above each longitudinal member. In this arrangement, the inner ends of the cantilevered beams may be pinned to the boom forward of the common pivot axis of the boom and the strut, and pivot members in the form of flanged cylindrical bearings which ride in a transverse trough in a bearing block mounted on top of each longitudinal member near the common pivot access, serve as a fulcrum for the respective cantilevered beams.

DESCRIPTION OF THE PREFERRED EMBODIMENT

Figure 1:
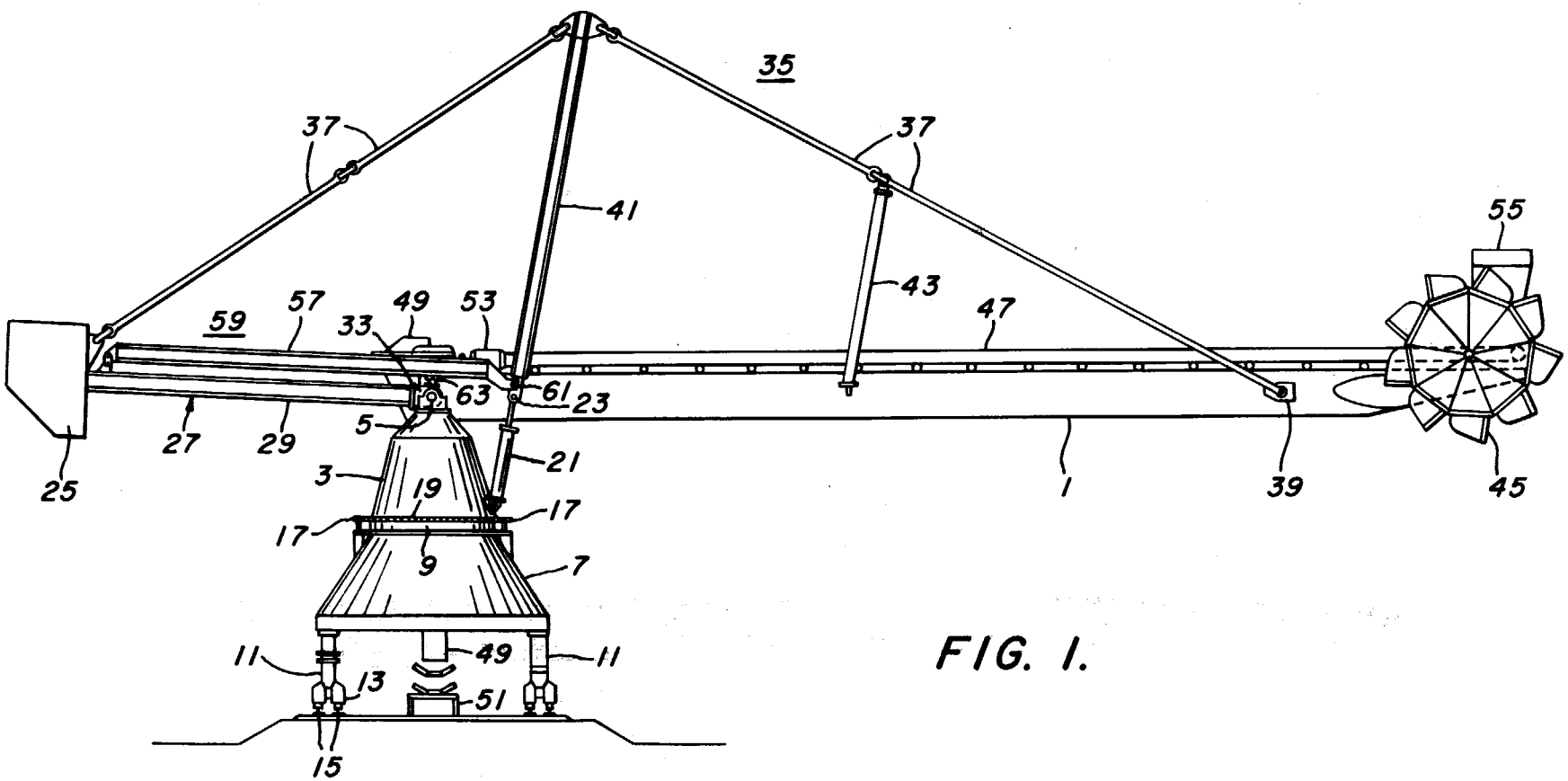
FIG. 1 is a side elevation view of a stacker-reclaimer embodying the invention.

The invention will be described as applied to a stacker-reclaimer although it will be appreciated by those skilled in the art that it has application to other types of material handling apparatus as well. As illustrated in FIG. 1, the stacker-reclaimer includes a boom 1 pivotally mounted near one end on a support structure 3 by a horizontal pivot pin 5. The boom 1 may be of tubular construction and the support structure 3 may comprise a conical shell. The support structure 3 is rotatably mounted on a cone-shaped gantry 7 by an annular slew bearing 9. The conical gantry 7 is supported by four (only two shown) legs 11. Multiple sets of truck assemblies 13 on each leg ride on double sets of railroad tracks 15.

The entire structure is movable along the railroad tracks 15 in a direction transverse to the plane of FIG. 1. The support structure 3 may be rotated through motor driven pinion gears 17 mounted on the gantry, which engage and drive the slewing gear 19 mounted on the support structure. A pair of hydraulic cylinders 21 (only one shown), pivotally mounted at one end to the support structure 3 and at the other end to either side of the boom 1 by pivot pins 23 located forward of the pivot pin 5, may be operated to raise and lower the boom in a vertical plane both above and below the horizontal.

A counterweight 25 is mounted on the end of a strut 27 which, in turn, is pivotally mounted on the support structure 3 diametrically opposite the boom 1 by the common pivot pin 5. The strut comprises a pair of elongated members 29 in the form of I-beams disposed on either side of the boom 1 and connected at several points by bracing 31 (see FIG. 3). Pin plates 33 pivotally secure the I-beams 29 to the pivot pin 5.

A pair of tension members 35 (only one shown) in the form of linked tension bars 37 are pivotally connected to the counterweight 25 and to a point 39 on either side and well out on the boom 1. A king post truss 41, pinned at the lower end to either side of the boom 1 by the pins 23 shared with the hydraulic cylinders 21, supports an intermediate portion of the tension members 35 aloft. Since the boom 1 in the illustrated stacker-reclaimer is approximately 150 feet long, an additional pair of supports 43 for the tension bars (only one shown) are provided on either side of the boom between the king post truss 41 and the point 39 well out on the boom.

A bucket wheel digger 45 is mounted on the free end of the boom 1. When the material handler is being operated as a reclaimer, the bucket wheel digger 45 scoops up and deposits material in a well known manner on a conveyor 47 extending along the length of the boom 1. The conveyor carries the material inward and deposits it in a chute 49 which extends downward through the shell of the support structure 3 and the conical gantry 7 and deposits it on the yard conveyor 51. When the machine is operated as a stacker, the conveyor motor 53 drives the conveyor in the opposite direction and material transferred from the yard conveyor 51 to the boom conveyor 47 by a tripper conveyor (not shown) is carried outward on the boom conveyor and discharged at the end thereof. The bucket wheel digger is not utilized during stacking. The machine is operated from the operator's cab 55 mounted on the end of the boom.

A pair of I-beams 57 are secured to either side of the boom and extend outward diametrically opposite the boom above the strut I-beams to form a cantilevered beam member 59. In the illustrated stacker-reclaimer the beams 57 are cantilevered by pinning the inner ends to the king post truss coupling on the respective side of the boom by a pin 61 through a fabricated offset section of the beam. A fulcrum for each cantilevered beam is formed by a pivot member 63 carried on the associated strut beam 29 above the pivot pin 5. Other arrangements for cantilevering the beams 57 from the boom could be used in place of the illustrated arrangement.

Figure 2:
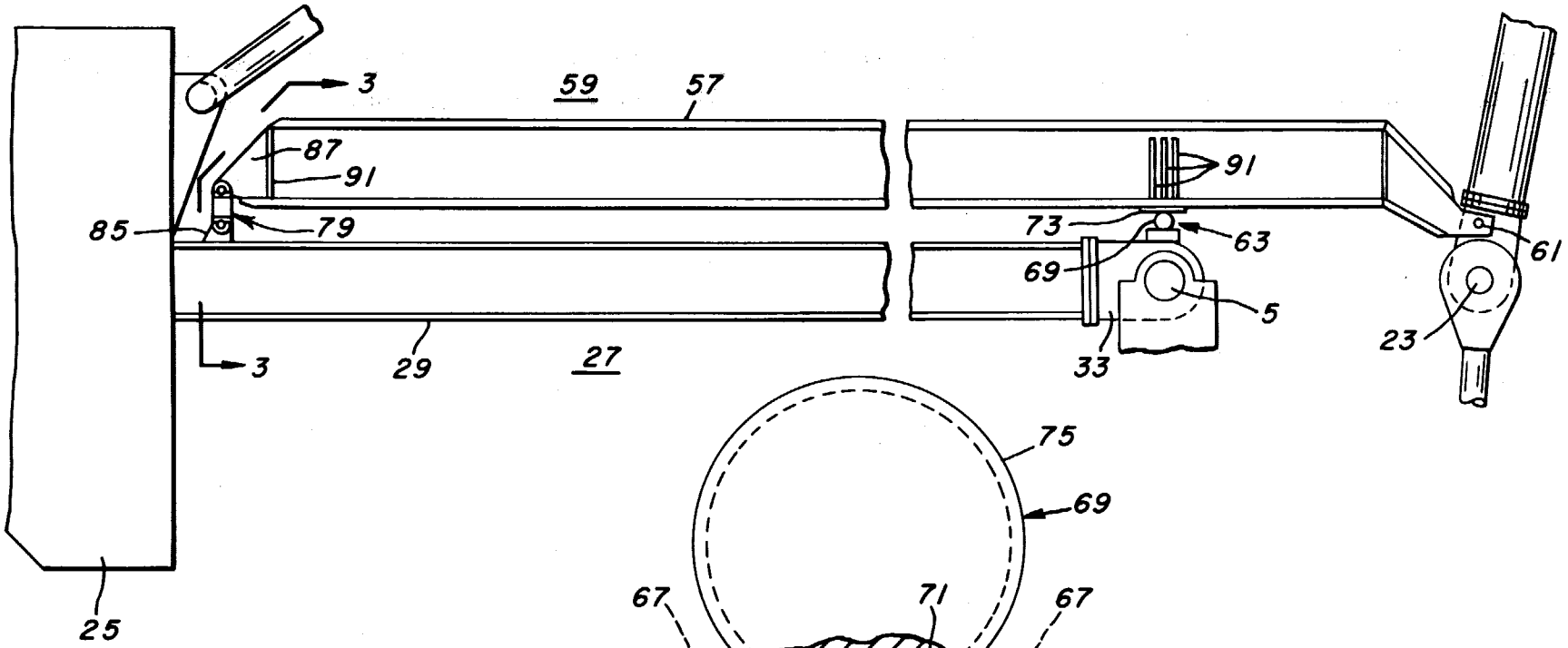
FIG. 2 is an enlarged view of a portion of the stacker-reclaimer illustrated in FIG. 1.
Figure 4:
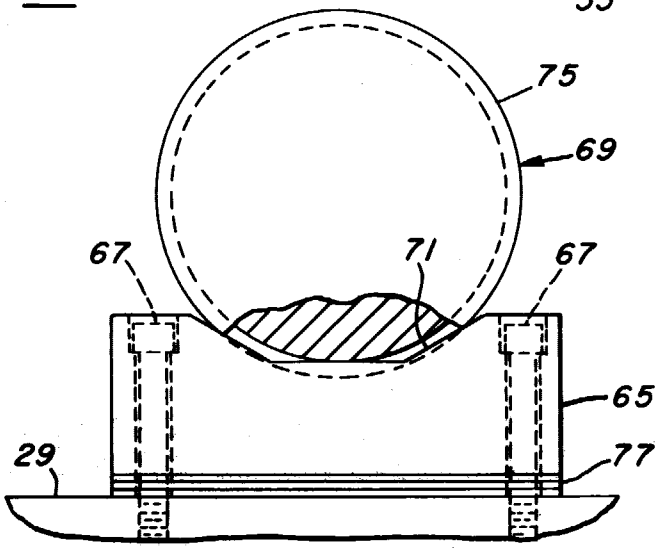
FIG. 4 is an enlargement of a portion of FIG. 2 with a portion cut away for clarity.

As best shown in FIGS. 2 and 4, the pivot members 63 include a bearing block 65 secured to the upper surface of each strut beam 29 by bolts 67. A cylindrical bearing 69 rides in a trough 71 formed in the upper face of the bearing block 65 and bears against a wear plate 73 on the underside of the respective cantilevered beam. Annular flanges 75 (only one shown) on either end of bearing block 65 maintain alignment of the parts. Shims 77 provide a means for adjusting the fulcrum and accommodating for wear of the parts.

Figure 3:
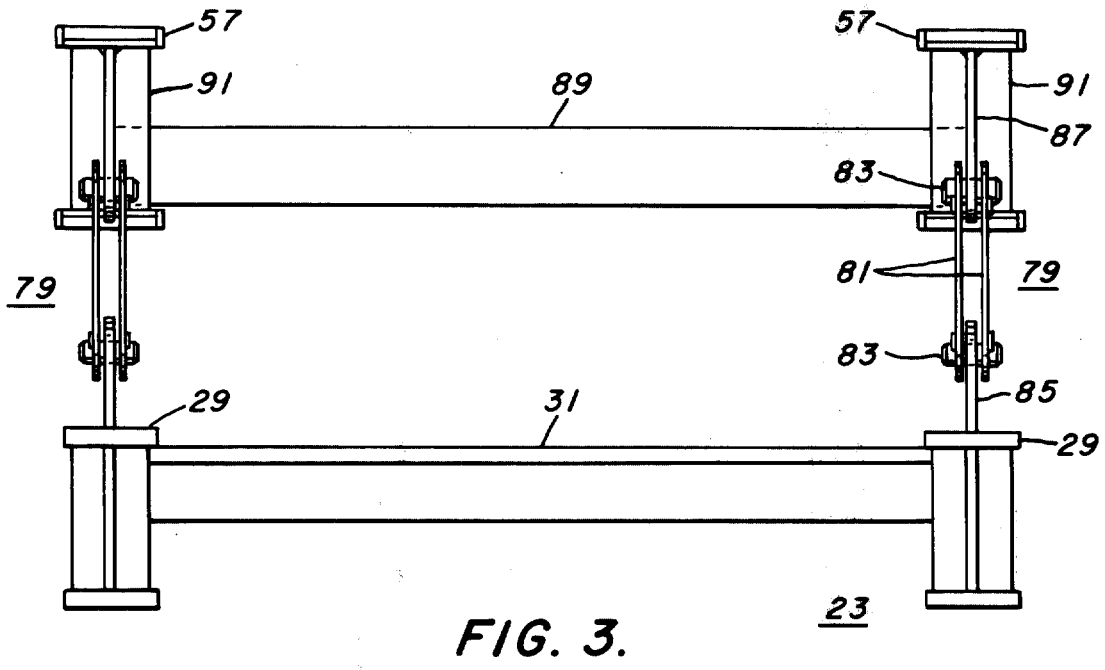
FIG. 3 is a section view taken along the lines 3—3 in FIG. 2.

As illustrated in FIGS. 2 and 3, the outer ends of the cantilevered beams 57 are coupled to the associated strut beam 29 by a linkage 79 which includes a pair of links 81 secured by pins 83 between a lug 85 on the strut beam and an extended section 87 of the web of the cantilevered beams. The two cantilevered beams are connected by a channel member 89 and are reinforced above the pivot member and at the outer ends by plates 91 welded to the webs and flanges of the cantilevered beams. The length of the links are such that a predetermined portion of the weight of the counterweight can be transferred to the cantilevered beams. This is accomplished with the beam set at a fixed angle by the hydraulic cylinders and with all live load removed from the boom. The outer ends of the cantilevered beams 57 and the strut beams 29 are drawn together such as by a jack frame (not shown). In this manner, a portion of the moment developed by the counterweight is transferred to the cantilevered beams as a bending moment. When the predetermined load has been transferred to the cantilevered beams, the linkages are installed and the jack frame removed. If the cantilevered beams were infinitely stiff, they would remain straight despite the predetermined load applied. However, in practice, the cantilevered beams bend as they are loaded. To accommodate for this, they are formed with a camber such that the free ends curve upward when unloaded. As they become fully loaded they become substantially straight as shown in FIGS. 1 and 2.

Figure 5:
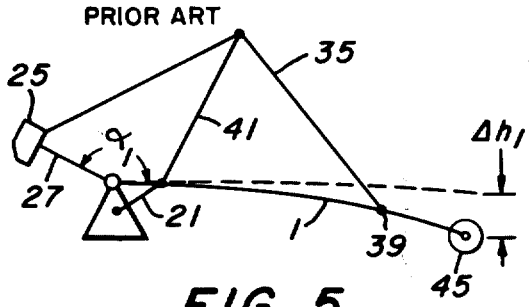
FIGS. 5 and 6 are schematic diagrams illustrating the effects of live load on prior art stacker-reclaimers.
Figure 7:
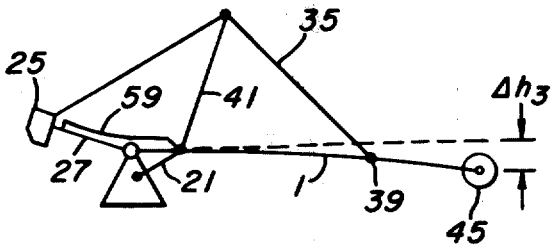
FIGS. 7 and 8 are schematic diagrams illustrating the effects of live load on a stacker-reclaimer embodying the invention.
Figure 6:
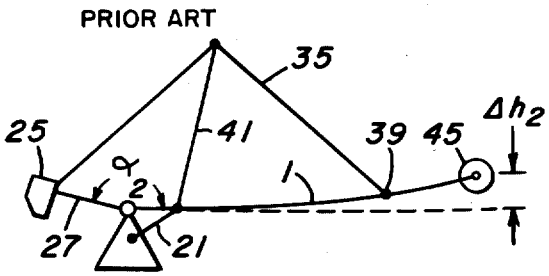
Figure 8:
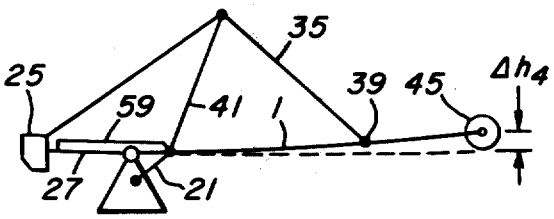

The operation of the invention can be more fully appreciated from the schematic diagrams of FIGS. 5 through 8 in which FIGS. 5 and 6 illustrate operation of the stacker-reclaimer without the invention and FIGS 7 and 8 illustrate the improved performance provided by the invention. The basic operation of the machine is the same in both cases. As the hydraulic cylinders 21 are extended and retracted, the boom 1 is raised and lowered. The counterweight 25 on the end of the pivoted strut is moved through a corresponding angle by the tension bars. The mass of the counterweight is selected to counterbalance a predetermined proportion of the forward overturning moment of the structure.

Turning particularly to FIGS. 5 and 6 and the operation of the machine without benefit of the invention, as the bucket wheel 45 begins to dig and the boom conveyor becomes loaded, the 150 foot long boom begins to bend. This bending causes the end of the boom to droop by the distance $\Delta h_1$. When the live load is removed, the moment generated by the counterweight causes the boom to bend upward so that the end rises by a distance $\Delta h_2$. The total excursion of the boom is therefore $\Delta h_1$ plus $\Delta h_2$. This total excursion results in the uneven bench in the material being reclaimed.

A more serious problem than an uneven bench, however, is that the bending of the boom can reach the point where the bucket wheel pulls itself down into the pile and stalls. One solution is to increase the size of the counterweight. This will reduce the droop $\Delta h_1$, however, it tends to increase the upward bend of the boom and, therefore, $\Delta h_2$ when the live load is removed. Thus it does not appreciably change the total excursion of the end of the boom and, therefore, the bucket wheel digger, but it can place increased loads on the boom when the live load is removed, which could easily exceed the buckle strength of the boom as can be realized from considering FIG. 6.

It should be noted from FIGS. 5 and 6 that with the position of the hydraulic cylinders 21 fixed, the application of live load to the boom 1 lowers the point 39 which raises the counterweight 25 thorugh the tension members 35. This reduces the angle $\alpha$ between the pivoted end of the boom which remains fixed and the strut 27 which is raised. Conversely, when the live load is removed and the end of the boom rises, the counterweight 25 is lowered and the angle $\alpha$ between the pivoted end of the boom 1 and the strut 27 increases. Thus $\alpha_2$ is larger than $\alpha_1$.

Turning to FIG. 8 and operation of the stacker-reclaimer with the benefit of the invention, it can be appreciated that with a predetermined portion of the moment developed by the counterweight 25 transferred to the cantilevered beam members 59 in the absence of live load on the boom 1, the upward bend of the boom, $\Delta h_4$, is reduced in comparison to $\Delta h_2$. As live load is picked up by the boom, the point 39 is pulled downward thereby raising the counterweight through the tension members 35. Since the pivoted end of the boom 1 carrying the cantilevered beam member 59 remains fixed, the strut 27 pivots clockwise with respect to the cantilevered beam member a viewed in FIG. 7. This removes the loading applied by the counterweight 25 to the cantilevered beam member 59 and applies the full moment developed by the counterweight to the boom. As the bending moment is removed from the cantilevered beam member, the upward camber in the beam member is restored. As live load is removed from the boom 1, the point 39 rises and the counterweight 25 settles thereby reapplying the predetermined loading to the cantilevered beam member 59 through bending.

It can be appreciated from the above that the invention reduces the overall excursion of the free end of the elongated boom. It can also be seen that with the invention a larger counterweight, which resists bending of the boom and the tendency of the bucket wheel digger to dig in and stall, can be applied to a given machine without the danger of exceeding the buckle strength of the boom when the live load is removed. All of these advantages are achieved by a simple structure which is easy to install and maintain.

I claim:

1. In material handling apparatus having: a boom pivotally supported at one end for movement in a vertical plane while maintaining an acute angle with the horizontal;

a strut pivotally supported at one end for movement in the same vertical plane as said boom although extending in the opposite direction, said strut also maintaining an acute angle with the horizontal;

a counterweight mounted near the free end of said strut;

a tension member connected between the counterweight and a point well out toward the free end of the boom to counterbalance at least a portion of the forward overturning moment generated by the boom with the moment generated by the counterweight; and a frame extending generally upward to pivotally support an intermediate portion of the tension member at a height above the pivoted ends of the boom and the strut, said pivoted boom and strut forming an upward facing angle which tends to decrease in size as the boom begins to bend upon the application of live load thereto, the improvement comprising:

a beam member cantilevered outward from the pivoted end of the boom in the direction of said strut, and means coupling the strut to the outer portion of the cantilevered beam member to transfer a portion of the moment produced by the counterweight to the cantilevered beam as the live load on the boom is decreased and the angle between the pivoted boom and strut tends to increase.

2. The material handling apparatus of claim 1 wherein said frame comprises a king post truss pinned at the lower end to said boom and at the upper end to the intermediate portion of the tension member.

3. The material handling apparatus of claim 2 wherein the coupling means includes means to transfer a predetermined portion of the moment produced by the counterweight to the cantilevered beam member in the absence of substantially all live load on said boom.

4. The material handling apparatus of claim 2 wherein said cantilevered beam member is disposed above said strut and wherein said coupling means includes a linkage which draws the outer portions of said cantilevered beam and strut toward each other to apply, through bending, a predetermined load on the cantilevered beam member.

5. The material handling apparatus of claim 4 wherein said cantilevered beam is cambered upward toward the outer end thereof to the degree that it becomes substantially straight when said predetermined load is applied thereto.

6. The material handling apparatus of claim 2 wherein said strut includes a pair of longitudinal members disposed on either side of the boom and pivoted about a common pivot axis therewith, and wherein said cantilevered beam includes a pair of beam members disposed on either side of said boom above said longitudinal members.

7. The material handling apparatus of claim 6 including means for pinning the inner ends of said beam members to the boom forward of the common pivot axis, and a pivot member located between each longitudinal member and beam member adjacent said common pivot axis of said boom and strut.

8. The material handling apparatus of claim 7 wherein said coupling means includes a linkage which draws the outer portions of the beam members and longitudinal members toward each other to apply, through bending, a predetermined load on said beam members.

9. The material handling apparatus of claim 7 wherein said pivot members each include a bearing block mounted on top of the associated longitudinal member and having a transverse upward facing trough therein, and a cylindrical bearing which rides in the trough and bears against the underside of the associated beam member, each said bearing block having annular flanges on either end thereof which engage the lateral edges of the associated bearing block to maintain bearing alignment.

* * * * *